US005107667A

United States Patent [19]

Tone et al.

[11] Patent Number: 5,107,667

[45] Date of Patent: Apr. 28, 1992

[54] SPINNING FRAME MANAGEMENT METHOD

[75] Inventors: Shoichi Tone; Kazuhiko Nakade, both of Kyoto, Japan

[73] Assignee: Murata Kikai Kabushiki Kaisha, Kyoto, Japan

[21] Appl. No.: 609,089

[22] Filed: Oct. 31, 1990

Related U.S. Application Data

[63] Continuation of Ser. No. 300,496, Jan. 23, 1989, abandoned.

[30] Foreign Application Priority Data

Jan. 24, 1988 [JP] Japan ..... 63-12562
Mar. 25, 1988 [JP] Japan ..... 63-69691

[51] Int. Cl.[5] ..... D01H 9/18
[52] U.S. Cl. ..... 57/264; 57/281
[58] Field of Search ..... 57/264, 265, 266, 274, 57/276, 281; 242/35.5 R, 35.5 A

[56] References Cited

U.S. PATENT DOCUMENTS 3,263,499 8/1966 Gith et al. ..... 57/281 X
4,168,604 9/1979 Mannhart ..... 57/264
4,246,748 1/1981 Artzt et al. ..... 57/264 X
4,399,648 8/1983 Kato ..... 57/264 X
4,570,865 2/1986 Kawarabashi et al. ..... 242/35.5 A
4,660,370 4/1987 Matsui et al. ..... 57/281
4,817,425 4/1989 Ueda et al. ..... 57/264 X

FOREIGN PATENT DOCUMENTS 41329 2/1987 Japan .

*Primary Examiner*—Joseph J. Hail, III
*Attorney, Agent, or Firm*—Spensley Horn Jubas & Lubitz

[57] ABSTRACT

A spinning frame management method comprising putting an identification mark on a tray for conveying a spinning bobbin produced by each spinning unit of a spinning frame to a winding unit of a winder, reading the identification mark in transferring the spinning bobbins from the spinning unit to the tray and storing the spinning unit which produced the same bobbin, detecting defects in the yarn of the spinning bobbin in rewinding the yarn of the bobbin and reading the identification mark put on the tray mounted with the same bobbin, and inquiring into the defects of a particular spinning unit by using the stored information.

23 Claims, 6 Drawing Sheets

SPINNING FRAME MANAGEMENT METHOD

This is a continuation of application Ser. No. 07/300,496 filed on Jan. 23, 1989, now abandoned.

FIELD OF THE INVENTION

The present invention relates to a spinning frame management method capable of tracing a spinning unit which produced a spinning bobbin of a defective yarn.

RELATED ART STATEMENT

Yarns produced by a spinning frame, particularly, a ring spinning frame, are conveyed and supplied in spinning bobbins to an automatic winder in the next process. The spinning bobbins are conveyed collectively in a box containing the bobbins randomly or regularly or the bobbins are conveyed individually along a conveying path extended between the spinning frame and the winder.

In either case, the spinning bobbins doffed from the spinning frame are supplied randomly to the winder. Accordingly, even if a yarn produced by a certain spinning unit is inferior in quality as compared with those produced by other spinning units, and such yarn causes breakage many times in the winding process, it is possible only to know that a yarn package wound on the winder has many joined portions. That is, the yarn spun by the particular spinning unit may be supplied to any one of the winding units of the winder a thus, spinning bobbins doffed from the spinning units which produce yarns of an inferior quality and those doffed from the normal spinning units are supplied randomly to the winder; consequently, many yarn packages produced by the winder contain yarns of inferior quality.

The applicant of the present patent application noticed this problem and developed a management system capable of individually managing the spinning units of a spinning frame by tracing a conveying path along which a yarn produced by a spinning unit, and causing excessive yarn breakage during rewinding on the winder back to the spinning unit which produced the same yarn, and by feeding back yarn breakage information obtained by the winder to the spinning frame (Japanese Pat. Laid-open No. 62-41329).

This management system specifies a spinning unit by extracting a spinning bobbin causing yarn breakage on a winding unit at a frequency exceeding a predetermined value, ejecting the empty tray from the winding unit, and reading an identification mark put on the tray by a reader while the tray is being conveyed. Although this management system is thus capable of finding a spinning unit which produced the spinning bobbin causing excessive yarn breakage, the management system is unable to find yarns having small defects which do not cause yarn breakage, namely, defects smaller than that corresponding to a sensitivity for which the slub catcher is set.

An automatic winder for winding yarns of spinning bobbins produced by a spinning frame in yarn packages has a sequential arrangement of a plurality of winding units. A yarn unwound from the bobbin at a high unwinding speed is wound in a yarn package rotated by a driving drum. When all the yarn of a bobbin is wound up, a new spinning bobbin is supplied to the winding unit, the yarn of the new bobbin and the end of the yarn wound on the yarn package are joined together, and then winding operation is restarted. The automatic winder is equipped with slub catchers for detecting defects in yarns. Upon the detection of a defective portion, such as an excessively thick portion, an excessively thin portion or an excessively large slub, greater than a set value, the slub catcher cuts the yarn.

However, some defects, such as variations in yarn evenness, caused by the spinning frame are not detected during winding operation. Variations in yarn evenness are classified into a periodic variation attributable to the eccentricity or deformation of the rollers or defects in the driving system of the spinning frame, and a non periodic variation attributable to the abrasion or the like of the surface of the aprons of the spinning frame. When yarns having periodic variation in yarn evenness are woven into a fabric, a defect, such as a moire pattern or the like, appears on the surface of the fabric to deteriorate the commercial value of the fabric remarkably. Thus, some types of variation in yarn evenness are significant defects.

Generally, some spinning bobbins are sampled from those produced by a spinning frame and the yarn evenness of the yarns of the sample bobbins is evaluated by means of testers, such as an Uster irregularity tester and a spectrographic tester, to test the quality of the yarns and to estimate defects in the spinning frame which produced those bobbins.

However, such a method of detection needs much time and labor for sampling, much time for inspection using testers, such as an Uster irregularity tester and a spectrographic tester, and is unable to test yarns at a sufficiently high accuracy. Since the winder is operating continuously during the test of the yarns requiring much time, a large amount of yarns having defective unevenness is wound in yarn packages before highly reliable final results of analysis are obtained.

In view of such a problem in the spinning frame, methods for solving problems attributable to the variation of yarn evenness are disclosed in Japanese Pat. Publication Nos. 60-52219 and 61-17929. A disclosed system employs an analyzing apparatus which converts analog signals provided by a yarn irregularity detector directly attached to a spinning machine into digital signals, and processes the digital signals by a computer in a real-time processing mode to analyze yarn evenness signals at a high accuracy in a very short time. This apparatus evaluates the yarn evenness of each of yarns being produced by a plurality of spinning units sequentially by sequentially applying yarn evenness signals provided by the plurality of spinning units through a multiplexer to a single analyzing unit.

However, the winder has specific problems different from those of the spinning frame. That is, whereas the spinning speed of the spinning frame is constant, the rotating speed of the driving drums of the winder is varied continuously for ribbon breaking, and hence the time axis varies. Accordingly, the analyzing apparatus such as mentioned above has not been applied to the winder.

Therefore, in winding yarns on the conventional winder, small yarn defects, such as variation in yarn evenness of a magnitude around a set value, among yarn defects are undetected and, if the set value is severe, the frequency of yarn breakage increases.

OBJECT AND SUMMARY OF THE INVENTION

It is an object of the present invention to provide a spinning frame management method capable of finding a spinning unit which produced a spinning bobbin having small yarn defects and, naturally, a spinning unit which produced a spinning bobbin frequently causing yarn breakage.

It is another object of the present invention to provide a defective bobbin detecting method capable of detecting small defects, such as variation in yarn evenness, in winding a yarn on a winder of a variable winding speed type and capable of accurately discriminating between normal bobbins and defective bobbins.

To achieve the foregoing object, the present invention provides a spinning frame management method comprising putting an identification mark on a tray for conveying a spinning bobbin produced by each spinning unit of a spinning frame to a winding unit of a winder, reading the identification mark in transferring the spinning bobbins from the spinning unit to the tray and storing the spinning unit which produced the same bobbin, detecting defects in the yarn of the spinning bobbin in rewinding the yarn of the bobbin and reading the identification mark put on the tray mounted with the same bobbin, and inquiring into the defects of a particular spinning unit by using the stored information.

In a winder of a variable winding speed type, a defective spinning bobbin detecting method according to the present invention comprises winding a yarn unwound from a new spinning bobbin and passed through an evenness detector; obtaining sample data by sampling a signal generated by the evenness detector a plurality of times, converting the sample data into digital data and storing the digital data in the initial stage of winding operation in which the winding speed is constant; processing the sample data through Fourier analysis by a computer; comparing the result of the Fourier analysis with a reference value by comparing means to decide if there is a periodic unevenness greater than the reference value.

According to the present invention, defects including small ones in the yarn are detected during rewinding a spinning bobbin on each winding unit and the identification mark put on a tray mounted with the bobbin is read. Thus, a spinning unit which produced a spinning bobbin having yarn defects causing yarn breakage and small defects which are not large enough to cause yarn breakage can be detected promptly and accurately.

DETAILED DESCRIPTION OF PREFERRED EMBODIMENT

Figure 2:
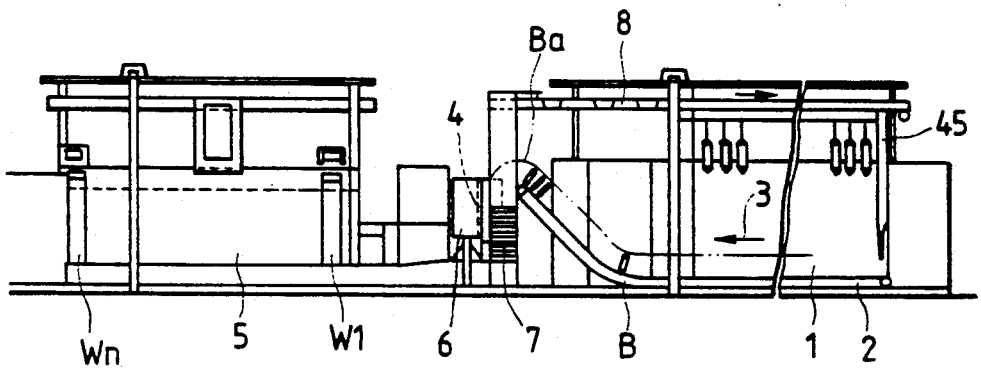
FIG. 2 is schematic front view showing one example of a spinning winder.
Figure 3:
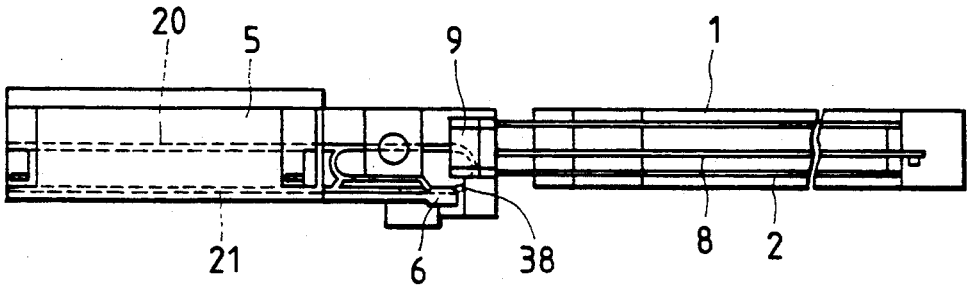
FIG. 3 is a plan view of the spinning winder of FIG. 2.

A spinning frame management method in a preferred embodiment according to the present invention will be described hereinafter with reference to the accompanying drawings, as applied to a so-called spinning winder, namely, a direct combination of a spinning frame and a winder. As shown in FIGS. 2 and 3, in a spinning winder disclosed, for example, in Japanese Patent Laid-open No. 59-163268, full spinning bobbins B produced by the spinning units of a spinning frame 1 are doffed simultaneously, and then the full bobbins B are put respectively on pegs fixedly arranged at a pitch corresponding to the pitch of the spinning unit on a transport band capable of running along the spinning units. Then, the transport band 2 moves intermittently in the direction of an arrow 3 in response to a bobbin request command provided by a winder 5 and puts a spinning bobbin Ba at the top of an inclined conveyor through a chute 4 on a bobbin tray waiting below the chute to supply the spinning bobbins sequentially.

On the other hand, the spinning bobbins put upright on the bobbin trays, namely, individual bobbin conveying media, are delivered to the winding units of the winder 5. After the yarns of the spinning bobbins have been wound up on yarn packages, empty bobbins are ejected. The empty bobbins or the like ejected from the winding units are conveyed together with the trays to a bobbin removing station 6, where the empty bobbins and almost depleted bobbins which cannot be supplied to the winding units are removed from the trays. The empty bobbins are returned through empty bobbin transport paths 7 and 8 to an empty bobbin supply position at one end of the spinning frame, while the almost depleted bobbins are ejected from the winder or stored in a box. Accordingly, only empty trays and trays each with a bobbin having residual yarn of an amount sufficient for resupply to the winder. Every time the empty tray arrives at a spinning bobbin supply station 9, the transport band 2 moves by a distance corresponding to the pitch, one bobbin is bobbin on the empty tray, and then the tray mounted with the bobbin is delivered again to the winding unit.

Figure 4:
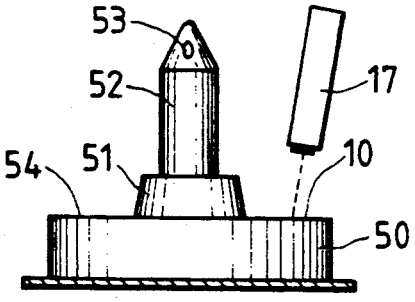
FIG. 4 is a front view of a bobbin tray showing a method for reading an identification mark attached to the bobbin tray.
Figure 5:
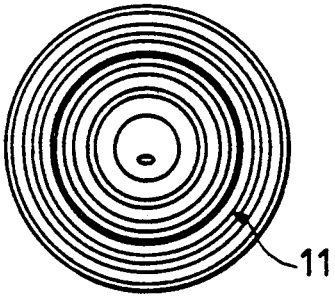
FIG. 5 is a plan view of the bobbin tray of FIG. 4.

FIGS. 4 and 5 show a bobbin tray employed in such a spinning winder for carrying out the spinning frame management method of the present invention. The tray T integrally comprises a base disk 50, a seat 51 on which the lower end of a bobbin is seated, and a peg 52 for supporting a bobbin in an upright position. The tray has a hollow structure provided with an air blowing hole 53 for blowing air therethrough at a winding position on the winding unit to blow out a yarn end inserted in the central hole of a bobbin mounted on the tray. A bar code label 10 marked with a bar code 11 consisting of concentric circles as identification mark as shown in FIG. 5 is applied to the upper surface 54 of the base disk 50 of the tray T. All the trays circulated through the winder are provided with bar code labels marked with different bar codes, respectively.

Figure 1:
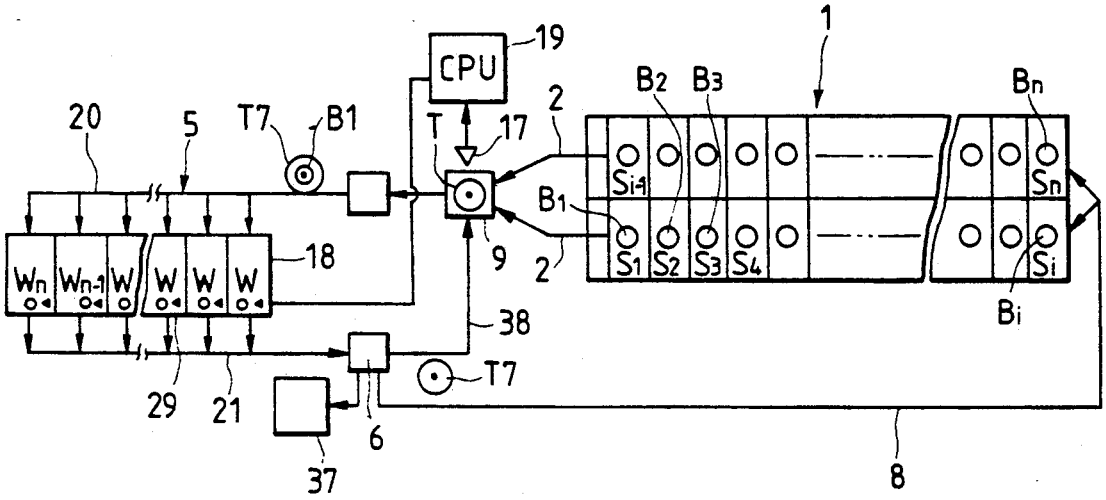
FIG. 1 is a view illustrating an elemental construction of an embodiment of the present invention.

For example, suppose that the spinning winder shown in FIG. 1 is a direct combination of a spinning frame 1 having four hundred spinning units, and a winder 5 having ten winding units $W_1$ to $W_n$ corresponding in yarn processing capacity to the spinning frame 1, each winding unit has a space for storing three bobbins, and fifty trays circulates through the winder 5. Then, labels marked respectively marked with bar codes 11 representing the trays Nos. 1 to 50 are applied to the trays, respectively.

Figure 6:
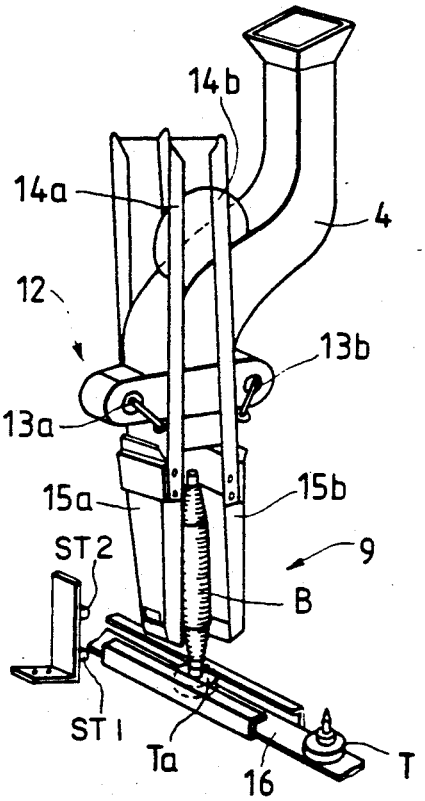
FIG. 6 is a perspective view showing one example of a bobbin supply station.

FIG. 6 shows, by way of example, the spinning bobbin supply station 9, where bobbins are put on the empty trays T. Upon the detection of the arrival of the empty tray T at a bobbin supply position T*a* by a tray sensor $ST_1$, a bobbin sensor $ST_2$ determines if any bobbin is on the tray T. When the tray is empty, a spinning bobbin supply request signal is given to the spinning frame. Then, the transport band 2 (FIG. 3) moves by a distance corresponding to the pitch, and then a spinning bobbin is dropped into the chute 4 to put the bobbin upright on the tray T. A spinning bobbin supply unit 12 comprises movable guide plates 15*a* and 15*b* pivotally supported for swing motion on shafts 14*a* and 14*b*, and rotary solenoid actuators 13*a* and 13*b* respectively for driving the movable guide plates 14*a* and 15*b*. The movable guide plates 15*a* and 15*b* guides a spinning bobbin and controls the transfer of the bobbin to a conveyor 16.

The bobbin removing station 6 shown in FIGS. 2 and 3 is provided with a bobbin removing device having a vertically movable chuck which removes a bobbin from a tray arrived at a bobbin removing position by chucking the bobbin and moving upward. The bobbin removing device delivers empty bobbins and almost depleted bobbins selectively to appropriate positions.

Bar code readers 17 and 18 for reading the bar code marked on the tray are provided in the spinning bobbin supply station 9 and each winding unit so that upper surface 54 of the tray is positioned opposite to the bar code readers 17 (18) as shown in FIG. 4 when the tray is stopped in place in the spinning bobbin supply station 9 (the winding unit). A tray identification signal provided by the bar code reader 17 is given to and stored temporarily in a controller 19. At the same time, a signal indicating the spinning unit which produced the bobbin put on the tray T is stored by a procedure, which will be described afterward.

Accordingly, in this embodiment, the tray and the bobbin put on the tray are specified in putting the bobbin on the tray.

Figure 7:
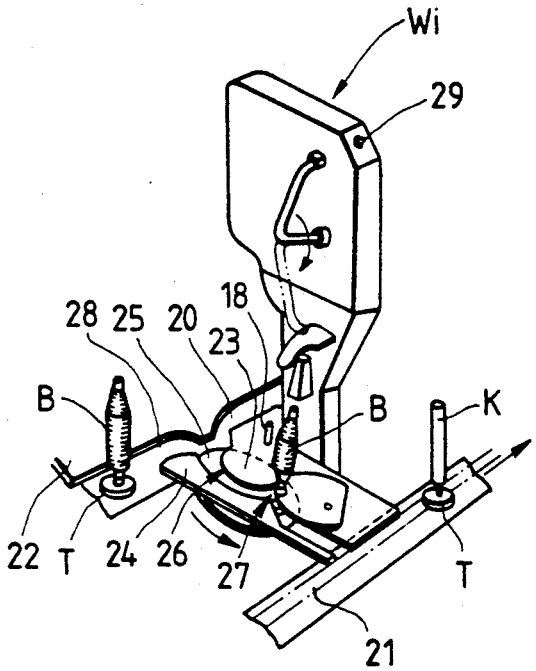
FIG. 7 is a perspective view showing one example of a winding unit.

FIG. 7 shows, by way of example, the winding unit. The winding unit automatically carries out the reception of the tray T mounted with the bobbin B from a bobbin transport path 20, the winding operation and the rejection of the bobbin. The bobbin transport path 20 and a bobbin return path 21 are extended along the winding units Wi respectively on the opposite sides of the same. Guide plates 22, 23 and 24 and a rotary disk 25 regulate the direction of advancement of the tray. The tray is guided automatically to the winding unit having a waiting groove 26 having a vacant space and is placed at a winding position. Once a predetermined number of spinning bobbins are stored in the waiting groove 26, the entrance of the following spinning bobbins into the waiting groove 26 is obstructed by the tray at the entrance of the waiting groove 26, and hence the following spinning bobbins advance through ; bobbin exit 28 toward the next winding unit. The bar code reader 18 reads the bar code put on the tray placed at the winding position 27. In unwinding the yarn from the bobbin placed at the winding position, a slub catcher provided in each winding unit detects yarn breakage and small defects which will not cause yarn breakage and give detection signals to the controller 19. The controller 19 accumulates the detection signals and stores the number of detection signals counted while each bobbin is unwound.

Each winding unit Wi is provided with a lamp 29 which flickers when the controller 19 provides a signal when the number of yarn breakage exceeds a predetermined number during winding operation for one spinning bobbin.

The functions of the embodiment will be described hereinafter.

Referring to FIG. 1, symbols are assigned respectively to all the spinning units of the spinning frame 1. For example, symbols $S_1$, $S_2$, $S_3$, . . . and $S_i$ are assigned respectively to the spinning units arranged sequentially from one end of the spinning frame 1 on the side of the winder on one side of the spinning frame 1, and symbols $S_{i+l}$, . . . $S_{i+n}$ are assigned respectively to the spinning units arranged sequentially on the other side of the spinning frame 1.

Suppose that simultaneous doffing operation has been completed and the bobbins $B_1$ to $B_i$ and bobbins $B_{i+1}$ to $B_{i+n}$ have been transferred to the transport bands 2 extended along the spinning units.

Then, when the spinning bobbin supply station 9 of the winder provides a spinning bobbin request signal, the bobbin $B_1$ at the left end of the spinning units on one side of the spinning frame 1 is put on the tray T. The tray T is transported at random. Suppose that the tray T is a tray No. T7. Then, the symbol $S_1$ is given by a counter as a symbol corresponding to the tray T7 to the memory of the controller 19 to store the symbol in the memory. When a tray T15 is used next, the bobbin $B_2$ is put on the tray T15, and the symbol $S_2$ is stored in the memory at an address corresponding to the tray T15.

Suppose that the tray T7 is transported to the winding unit $W_3$ of the winder and placed at the winding position.

The bar code reader 18 reads the bar code 11 marked on the tray placed at the winding position and gives the tray number T7 to the controller 19. While the yarn of the bobbin placed at the winding position 27 is being wound, the slub catcher detects yarn defects and gives a detection signal to the controller 19 every time a defect is detected. The controller 19 counts the number of the yarn defect detection signals. When the number of the yarn defect detection signals exceeds a predetermined number, the controller 19 decides that the yarn of the bobbin $B_1$ on the tray T7 is a defective yarn, specifies the spinning unit $S_1$ which produced the bobbin B, and makes the lamp 29 of the same spinning unit flicker.

Since the spinning unit which produced a spinning bobbin of a defective yarn can be thus detected and specified, the operator is able to determine that something is wrong with the same spinning unit and to inspect the same spinning unit.

On the other hand, upon the recognition of the flickering lamp 29, the operator removes the bobbin on the tray T7 carrying the bobbin ejected from the unit. After the bobbin has been removed, the empty tray T7 is conveyed along the bobbin return path 21 toward the bobbin removing station 6. The trays carrying empty bobbins and ejected from the other wind units and empty trays from which defective bobbins have been removed by the operator are transported in a random sequence along the bobbin return path 21.

At the bobbin removing station 6, the empty bobbins and almost depleted bobbins are removed from the trays, while the empty trays and trays carrying bobbins having sufficient residual yarns pass through the bobbin removing station 6.

The empty bobbins removed from the trays at the bobbin removing station 6 are returned through a transport path 8, such as a conveyor or the like, to one end of the spinning frame 1 opposite the bobbin delivery end of the spinning frame 1 and are put on the pegs provided on the transport band. The almost depleted bobbins are separated from the empty bobbins and are delivered into a bobbin box 37 provided near the bobbin removing station 6. Accordingly, empty trays and trays carrying bobbins each having a sufficient residual yarn are conveyed in a random sequence on a path 38 between the bobbin removing station 6 and the spinning bobbin supply station 9.

Figure 8:
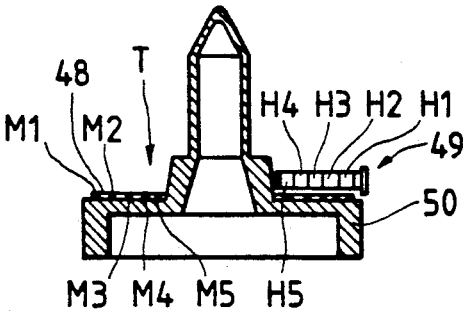
FIG. 8 is a longitudinal sectional view of a bobbin tray showing another method for reading an identification mark attached to the bobbin tray.
Figure 9:
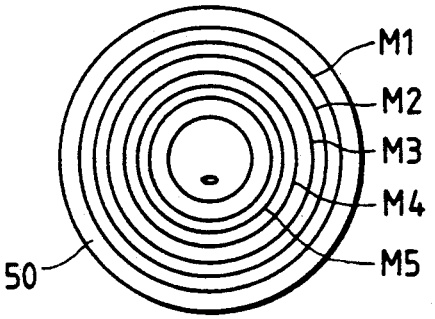
FIG. 9 is a plan view of the bobbin tray of FIG. 8.

Shown in FIGS. 8 and 9 is another exemplary bar code put on a tray. A rubber plate 48 with concentric magnetic rings $M_1$ to $M_5$ buried therein is attached to the upper surface of the base disk 50 of the tray T. The tray is identified from the combination of the base plate and demagnetization of each of the magnetic rings $M_1$ to $M_5$. Indicated at 49 is a reader having an arrangement of Hall elements $H_1$ to $H_5$ of a number the same as that of the magnet rings $M_1$ to $M_5$. The reader 49 detects the condition of magnetization of the magnet rings.

As is apparent from the foregoing description, according to the present invention, defects including small defects of the yarn of a spinning bobbin are detected and the identification mark put on the tray for carrying a spinning bobbin is read at each winding unit, a spinning unit which produced a spinning bobbin of a yarn frequently causing yarn breakage or a yarn having small defects which are not large enough to cause yarn breakage can be specified promptly and accurately, which is very effective for producing yarns of good quality.

A defective bobbin detecting method effectively applicable to the automatic winder will be described hereinafter.

A yarn unwound from a new spinning bobbin is wound up in a yarn package after being passed through the yarn evenness detector. Although the winding speed of the winder is not always constant to prevent ribboning, the winder operates at a constant winding speed for a time interval several times. In the initial time interval in which the winding speed is fixed, a signal generated by the yarn evenness detector is sampled several times to obtain correct digital data excluding factors attributable to the variation of the winding speed. The signal is sampled only in the initial time interval in which the winding speed is fixed on an assumption that the variation in yarn evenness of the yarn wound on the bobbin can be represented by the variation in yarn evenness of the yarn initially unwound from the bobbin, and hence it is possible to decide if all the yarn of the spinning bobbin is defective from the variation in yarn evenness of the initial portion of the yarn. The sample data is processed by the computer for Fourier analysis, and then the result of the Fourier analysis is compared with a reference value by the comparing means to decide if the periodic unevenness of the yarn is greater than the reference value. The yarn evenness detector may be a slub catcher provided on the winder or an individual detector additionally provided on the winder.

A defective bobbin detecting method embodying the present invention will be described hereinafter with reference to the accompanying drawings.

Figure 11:
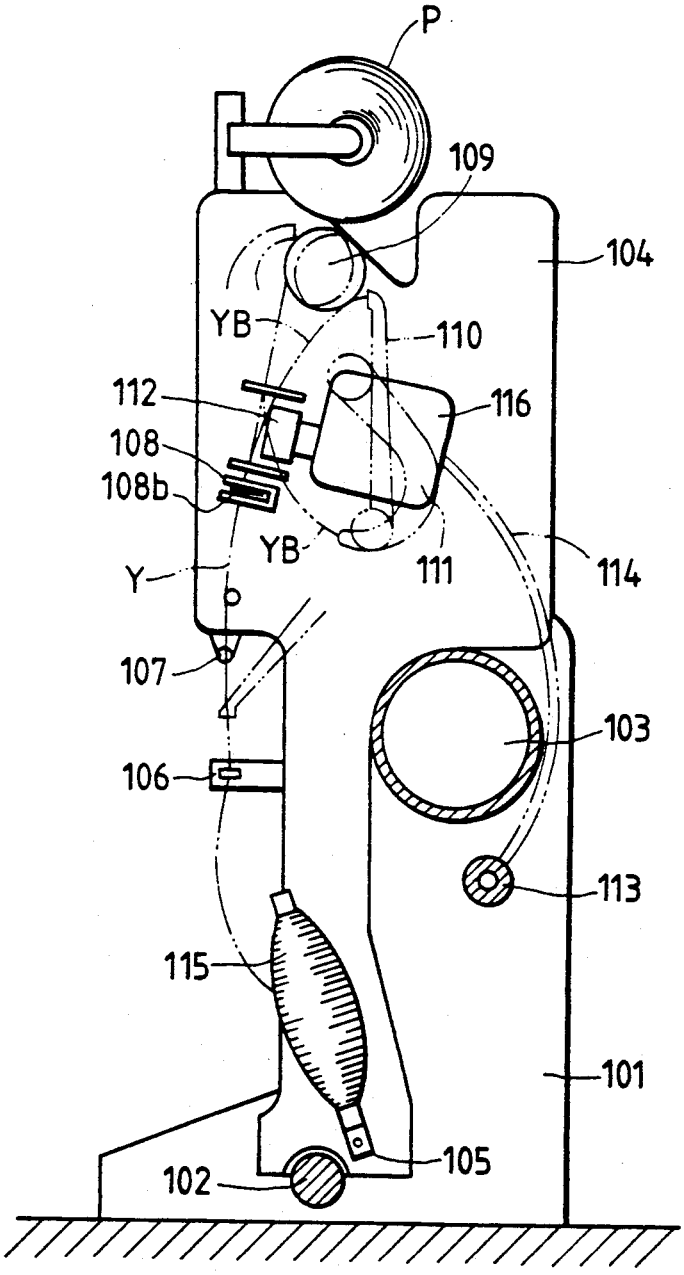
FIG. 11 is a schematic illustration showing an automatic winder for carrying out the present invention.

Referring to FIG. 11 schematically showing an automatic winder for carrying out a defective bobbin detecting method according to the present invention, a supporting shaft 102 and a suction pipe 103 are extended between side frames 101. Winding units 104 are supported pivotally on the supporting shaft 102. During automatic winding operation, the winding units 104 rest also on the suction pipe 103 and are held fixed by suitable means. The suction pipe 103 is connected to a blower, not shown, so that air flows continuously for suction.

To wind the yarn Y of a spinning bobbin 115 in a yarn package P on the winding unit 104, the yarn Y pulled out from the bobbin 115 put on a peg 105 is passed through a guide 106, a tension device 107 for applying an appropriate tension to the yarn Y, and a yarn evenness detector (slub catcher) both for cutting the yarn Y upon the detection of an uneven portion greater than a reference value and for detecting the run of the yarn, and is wound on the yarn package P being driven for rotation by a grooved drum 109.

Figure 10:
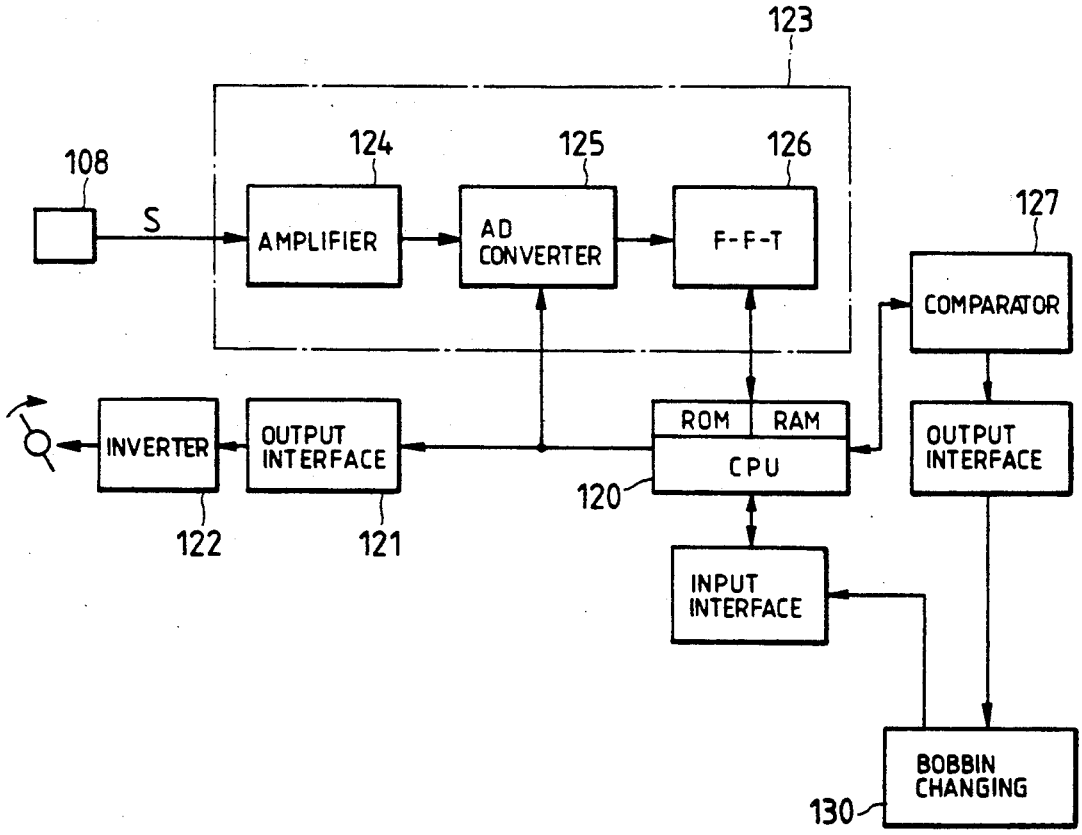
FIG. 10 is a block diagram illustrating a construction of a defective bobbin detecting apparatus according to the present invention.

The rotating speed of the grooved drum 109 is controlled for stepless variation by an inverter (frequency controller) 122 shown in FIG. 10. A microcomputer 120 gives a speed command through an output interface 121 to the inverter 122. A rotating speed control mode for controlling the rotating speed of the grooved drum 109 during winding operation is a combination of a fixed speed control mode, in which the rotating speed of the grooved drum 109 is fixed, and a variable speed control mode, in which the rotating speed is varied for ribbon breaking.

The yarn evenness detector 108 is a highly sensitive and highly responsive detector of an electrostatic type or of a photoelectric type employing a light emitting diode and a phototransistor. Upon the detection of a very large variation in an electrical value resulting from the passage of a slub in the yarn through the yarn evenness detector 108, the yarn evenness detector 108 actuates a cutter disposed near the yarn evenness detector 108 to cut the running yarn Y and stops the winding operation.

After the slub has been detected and the winding operation has been stopped, a first suction yarn guide arm 110 connected to the suction pipe 103 pulls out the yarn YB of the bobbin 115 and takes the yarn YB to a yarn joining device 112 disposed apart from a normal yarn path. The yarn joining device 112 untwists the free ends of the yarns YP and YB by suction, and then joins together the yarn ends of the yarns YP and YB by splicing the untwisted ends of the yarns YP and YB one over the other by a compressed fluid, in this embodiment, compressed air, supplied to a yarn splicing box 116 through a pipe 113 and a tube 114. After the yarns YP and YB have thus been joined together, the winding operation is restarted.

FIG. 10 shows the constitution of a controller having a microcomputer 120 and provided in each winding unit 104.

An electric signal S generated by the yarn evenness detector 108 is used for cutting the yarn and, on the other hand, the electric signal S is applied to the yarn evenness signal processing unit 123 of the controller. The yarn evenness signal processing unit 123 samples the electric signal S several times in a time interval in which the rotating speed of the grooved drum 109 is fixed, particularly, in the initial time interval in which the rotating speed of the grooved drum 109 is fixed, and processes the sample data for digital analysis.

Referring to FIG. 10, an amplifier 124 amplifies the analog electric signal S provided by the yarn evenness detector 108 to a voltage level optimum for AD conversion, and then an AD converter 125 converts the analog signal into a digital signal.

The AD converter 125 is an accurate oscillator which produces a data sampling time corresponding to a frequency bandwidth for analysis in the initial time period in which the rotating speed of the grooved drum 109 is fixed after a new bobbin has been supplied for winding, samples the input signal several times to obtain sample data and converts the sample data into digital signals. The microcomputer 120 gives an instruction indicating a predetermined time interval synchronous with the speed command given to the inverter 122, namely, the initial time interval after the bobbin has been changed, in which the rotating speed of the grooved drum 109 is fixed, to the AD converter 125. The digital sample data provided by the AD converter 125 is stored in the RAM of the microcomputer 120.

The stored sample data obtained by a predetermined number of sampling cycles is multiplied by window function, and then the multiplied sample data is transferred to a Fourier transformer 126 for fast Fourier transform (FFT). The results of the FFT are subjected vector synthesis to obtain a power spectrum showing the frequency components.

An output processing circuit cuts a portion of an output signal representing the power spectrum showing the frequency components, including signal components of frequencies not less than a predetermined frequency for example, 50 Hz, to adjust the signal so as to be suitable for analysis, and then the adjusted signal is stored in the RAM of the microcomputer 120 or, in some cases, the output signal of the Fourier transformer 126 is applied to a DA converter to convert the output signal into analog values and the analog values are displayed in a graph on a display, not shown.

The data thus obtained through fast Fourier transform is read from the RAM of the microcomputer 120, and then the data is compared with a set value by a comparator 127 to evaluate the yarn. When the yarn of the bobbin has a periodic unevenness exceeding a reference value and is decided to be defective, the yarn is cut, the winding operation is stopped, and then the defective bobbin is changed for a new bobbin by a bobbin changing unit 130. Since the sample data is a correct data unaffected by the variation of the running speed of the yarn, the reference value may be severer than the set value for the detection of slubs.

Figure 12A:
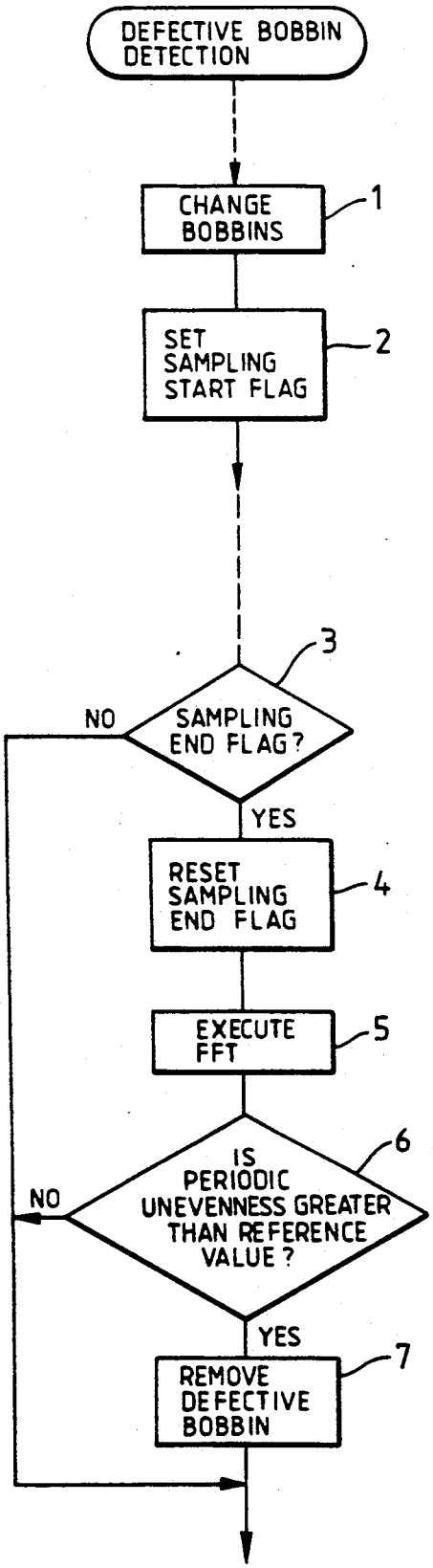
FIGS. 12*a* and 12*b* are flow charts showing an example of a program stored in a microcomputer.
Figure 12B:
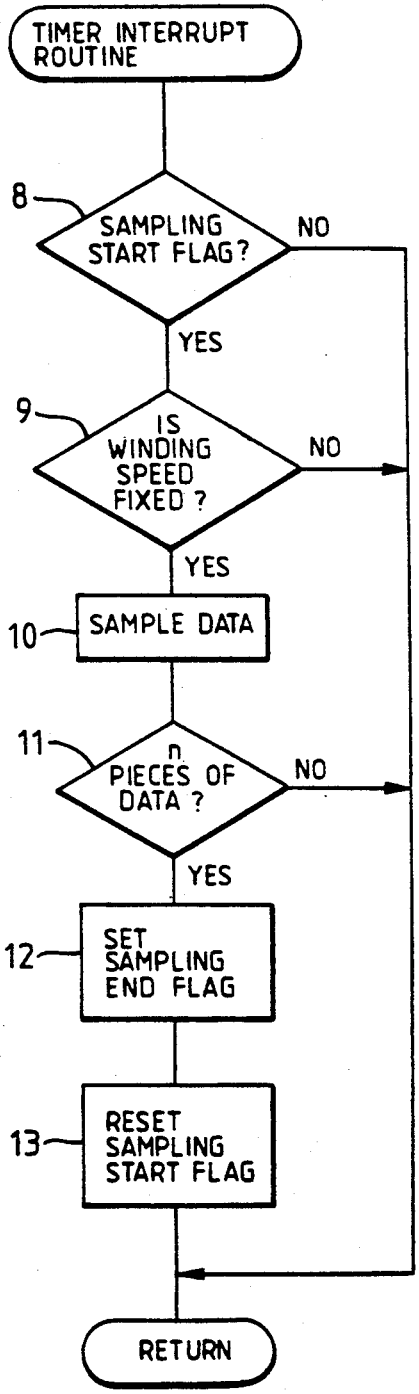

Basically, the microcomputer 120 comprises a central processing unit (CPU), a ROM and a RAM. Programs shown in FIGS. 12*a* and 12*b* are stored in the ROM. The CPU receives data signals from the yarn evenness signal processing unit 123, interchanges data with the RAM, processes data and, when necessary, provides processed data according to the programs.

FIG. 12*a* shows a main routine for controlling defective bobbin detection and FIG. 12*b* shows a timer interrupt routine which is executed at fixed timer intervals for sampling.

Referring to FIG. 12*a* showing the main routine, in step ①, a bobbin change command is given to the bobbin changing unit 130 to set a new bobbin. In step ②, a sampling start flag is set. In step ③, a decision is made whether or not a sampling cycle has been executed predetermined times (n times).

On the other hand, in the timer interrupt routine shown in FIG. 12*b*, a decision is made in step ⑧ whether or not the sampling start flag has been set. When the decision in step ⑧ is affirmative, a decision is made in step ⑨ whether or not the winding operation is in a time period in which the winding speed is fixed. When the decision in step ⑨ is affirmative, sampling is executed in step ⑩. In step 11 a decision is made whether or not sampling has been executed predetermined times (n times). When the decision in step ⑪ is negative, the routine returns to step ⑧. Thus, the loop of steps ⑧ to ⑪ is repeated to execute sampling predetermined times (n times). When the decision in step ⑪ is affirmative, a sampling end flag is set in step ⑫, the sampling start flag is reset in step ⑬, and then the routine returns to the main routine.

After a sample data has thus been obtained through the predetermined times (n times) of sampling operation, the sampling end flag is reset in step ④ of the main routine shown in FIG. 12*a*, and then the sample data is subjected to FFT in step ⑤. In step ⑥, a decision is made on the basis of the results of FFT whether or not the yarn of the bobbin has a periodic unevenness exceeding the reference value. When the decision in step ⑤ is affirmative, a bobbin change command is given to the bobbin changing unit 130 in step ⑦ to complete the defective bobbin detecting routine by changing the defective bobbin for a new bobbin.

That is, according to this defective bobbin detecting routine, the thickness of the yarn is inspected only in the initial time period in which the winding speed is fixed after a new bobbin has been set by the bobbin changing unit 130 and winding operation has been started to start winding the yarn of the new bobbin, and further inspection of the thickness of the yarn is not executed for the same bobbin in the subsequent time intervals in which the winding speed is fixed. However, since the variation of the thickness of the yarn in the rest of the portions of the bobbin is the same as that of the yarn in the outer portion of the bobbin, the inspection of the thickness of the yarn in the outer portion of the bobbin is sufficiently effective.

Although, in this embodiment, when a bobbin is decided to be defective, the defective bobbin is changed for a new bobbin, it is also possible to generate an alarm sound or to display an abnormality signal.

As is apparent from the foregoing description, the defective bobbin detecting method in accordance with the present invention samples a signal provided by a yarn evenness detector several times in an initial time interval in which the winding speed is fixed after the yarn of a new bobbin has passed through the yarn evenness detector and winding operation for winding the yarn has been started, and hence correct data excluding factors attributable to the variation of the winding speed can be obtained. Accordingly, it is possible to decide readily if the yarn has a periodic unevenness exceeding a reference value by subjecting the sample data to Fourier analysis and comparing the results of the Fourier analysis with the reference value by the comparing means. That is, it is possible to decide if the bobbin is defective on the basis of a severe set value, so that it is possible to avoid winding the yarns having a large variation in thickness of defective bobbins and normal yarns of correct bobbins together in the same yarn package.

Furthermore, since it is possible to decide if the yarn is defective in the initial time interval in which the winding speed is fixed immediately after the start of winding operation for a new bobbin, the defective yarn is not wound on the yarn package and the defective bobbin can be changed promptly for a new bobbin.

Accordingly, the present invention is particularly suitable for application to selectively eliminating only defective bobbins in a system including an automatic winder directly combined with a spinning frame, for winding yarns of various types, in which trays respectively carrying various bobbins are transported in a random sequence.

What is claimed is:

1. A spinning frame management method comprising the steps of:

putting an identification mark on a tray for conveying a spinning bobbin produced by each spinning unit of a spinning frame to a winding unit of a winder;

reading the identification mark and transferring the spinning bobbin from the spinning unit to the tray, storing information corresponding to the spinning unit which produced the spinning bobbin;

rewinding yarn from the spinning bobbin at a constant speed for a predetermined period of time, and at a variable speed after the predetermined period of time;

detecting minor defects in the yarn of the spinning bobbin during the predetermined period in which the winding speed is constant, thereby preventing detection of factors attributable to variations in the winding speed, wherein minor defects are smaller than defects which cause yarn breakage, reading the identification mark on the tray mounted with the spinning bobbin; and inquiring into the defects of a particular spinning unit by using the stored information.

2. The spinning frame management method as claimed in claim 1, wherein the identification mark is a bar code and each tray circulated through the winding units is marked with a different bar code, respectively.

3. The spinning frame management method as claimed in claim 2, further comprising the steps of:

providing a spinning bobbin supply station between the spinning frame and the winding units, detecting the arrival of a tray at the bobbin supply station and detecting whether the tray is empty, and putting a spinning bobbin on an empty tray upon the detection of the arrival of the empty tray at a bobbin supply position of the bobbin supply station.

4. The spinning frame management method as claimed in claim 1, wherein the identification mark is a rubber plate with concentric magnetic rings buried therein so that the identification mark is read by detecting the condition of magnetization of the magnet rings.

5. The spinning frame management method as claimed in claim 1, further comprising the steps of generating a detection signal corresponding to each detected defect, counting the detection signals, and storing the number of detection signals counted while each spinning bobbin is unwound.

6. The spinning frame management method as claimed in claim 5, further comprising the step of:

activating an alarm indicator when the number of detection signals exceeds a predetermined number during a winding operation for one spinning bobbin.

7. The spinning frame management method as claimed in claim 1, wherein the step of detecting defects in the yarn further comprises the steps of:

winding a yarn from a new spinning bobbin, passing the yarn through an evenness detector;

obtaining sample data by sampling a signal generated by the evenness detector, converting the sample data into digital data, storing the digital data in the initial stage of winding operation in which the winding speed is constant;

processing the sample data through Fourier analysis by a computer; and comparing the result of the Fourier analysis with a reference value to determine if there is a periodic unevenness greater than the reference value.

8. In a winder of a variable winding speed type, a defective bobbin detecting method comprising:

winding a yarn unwound from a new spinning bobbin at a constant speed for a predetermined period of time, and at a variable speed after the predetermined period of time;

passing the yarn through an evenness detector;

obtaining sample data by sampling a signal generated by the evenness detector, converting the sample data into digital data, storing the digital data during the predetermined period in which the winding speed is constant, thereby eliminating from the digital data factors attributable to variations in the winding speed;

processing the sample data through Fourier analysis by a computer; and comparing the result of the Fourier analysis with a reference value to determine if there is a periodic unevenness greater than the reference value.

9. An apparatus for controlling a yarn spinning frame, comprising:

a plurality of spinning units, a winder including a plurality of winding units, conveying means for conveying a spinning bobbin produced by one of the spinning units to one of the winding units, an identification mark disposed on the conveying means, transferring means for transferring the spinning bobbin from one of the spinning units to the conveying means, first reading means provided on the transferring means for reading the identification mark, first storage means for storing the identification mark read by the first reading means and for storing information indicative of the spinning unit which produced the spinning bobbin being conveyed, detecting means for detecting minor defects in the yarn, wherein minor defects are smaller than defects which cause yarn breakage, control means for controlling the detecting means to prevent the detecting means from detecting factors attributable to variations in the winding speed of the winding units;

second reading means for reading the identification mark corresponding to the yarn being detected, second storage means for storing the identification mark read by the second reading means, and first processing means for processing the identification marks stored by the first and second reading means.

10. The apparatus as claimed in claim 9, wherein the identification mark is a bar code.

11. The apparatus as claimed in claim 9, wherein the conveying means comprises a tray, and wherein a spinning bobbin supply station is provided between the spinning frame and the winding units, wherein the spinning bobbin supply station further comprises, a first sensor for sensing the arrival of an empty tray at a bobbin supply position of the bobbin supply station, a second sensor for sensing whether the tray is empty, and means for placing a bobbin on the tray when an empty tray is detected.

12. The apparatus as claimed in claim 9, wherein the identification mark further comprises:

a rubber base plate, and a plurality of concentric magnetic rings embedded in the rubber base plate, whereby the first and second reading means read the magnetization of the rings.

13. The apparatus as claimed in claim 9, wherein the detecting means further comprises, first generating means for generating a number of detection signals corresponding to the number of detected defects, and a third storage means for storing the number of detection signals.

14. The apparatus as claimed in claim 13, further comprising:

an alarm indicator which generates an alarm signal in response to the third storage means when the number of detection signals exceeds a predetermined number.

15. The apparatus as claimed in claim 9, wherein the detecting means further comprises, a yarn evenness detector, second generating means for generating an evenness signal in response to the evenness detector, sampling means for sampling the evenness signal to obtain sample data, converting means for converting the sample data into digital data, fourth storage means for storing the digital data, second processing means for processing the digital data through Fourier analysis, and comparing means for comparing the results of the Fourier analysis with a reference value.

16. A method for controlling a spinning frame, the method comprising the steps of:

placing an identification mark on a conveying tray;

transferring a spinning bobbin from a spinning unit to the tray, reading the identification mark on the tray;

storing the read identification mark and information indicative of the spinning unit which produced the spinning bobbin, winding yarn from the spinning bobbin at a constant speed for a predetermined period of time, and at a variable speed after the predetermined period of time;

detecting minor defects in the yarn during the predetermined period in which the winding speed is constant, thereby preventing detection of factors attributable to variations in winding speed, wherein minor defects are smaller than defects which cause yarn breakage, re-reading the identification mark on the tray;

storing the identification mark on the tray which corresponds to the yarn being detected.

17. A method as claimed in claim 16, wherein the step of placing an identification mark on a tray further comprises the step of placing a bar code on the tray.

18. The method as claimed in claim 16, further comprising the steps of:

supplying a tray to a spinning bobbin supply station;

detecting whether the tray is empty or has a bobbin thereon, and placing a spinning bobbin on the tray when an empty tray is detected.

19. The method as claimed in claim 16, wherein the step of putting an identification mark on the tray further comprises the step of putting a rubber plate having concentric magnetic rings imbedded therein on the tray, and wherein the step of reading the identification mark on the tray further comprises the step of detecting the condition of magnetization of the magnet rings.

20. The method as claimed in claim 16, wherein the step of detecting defects in the yarn further comprises the step of generating a detection signal corresponding to each of the detected defects in the yarn, and storing and counting the number of detection signals.

21. The method as claimed in claim 20, further comprising the step of activating an alarm indicator when the number of detection signals exceeds a predetermined number.

22. The method as claimed in claim 16, wherein the step of detecting defects in the yarn further comprises the step of:

passing the yarn through a yarn evenness detector;

generating an evenness signal corresponding to the evenness of the yarn, obtaining sample data from the evenness signal, converting the sample data into digital data, storing the digital data, processing the digital data through Fourier analysis, and comparing the result of the Fourier analysis with a reference value.

23. A method for controlling a yarn winder, comprising the steps of:

winding a yarn at a constant speed for a predetermined period of time, and at a variable speed after the predetermined period of time;

passing the yarn through a yarn evenness detector, generating an evenness signal corresponding to the evenness of the yarn, obtaining sample data from the evenness signal, converting the sample data into digital data, storing the digital data during the predetermined period in which the winding speed is constant, thereby eliminating from the digital data factors attributable to variations in the winding speed;

processing the digital data through Fourier analysis, and comparing the result of the Fourier analysis with a reference value.

* * * * *